United States Patent [19]

Horii et al.

[11] Patent Number: 4,930,763

[45] Date of Patent: Jun. 5, 1990

[54] PAPER FEEDING APPARATUS

[75] Inventors: Yoshiyuki Horii; Koji Oishi, both of Kyoto, Japan

[73] Assignee: Horizon International, Inc., Shiga, Japan

[21] Appl. No.: 309,093

[22] Filed: Feb. 10, 1989

[30] Foreign Application Priority Data

Feb. 18, 1988 [JP] Japan ..... 63-36401

[51] Int. Cl.[5] ..... B65H 3/08

[52] U.S. Cl. ..... 271/31; 271/11; 271/147

[58] Field of Search ..... 414/797, 796.7; 271/5, 271/11, 12, 98, 103, 104, 105, 107, 30.1, 31, 147, 160, 162

[56] References Cited

U.S. PATENT DOCUMENTS

| | | | |
|---|---|---|---|
| 2,276,683 | 3/1942 | Bailey | 271/31 |
| 2,902,278 | 9/1959 | Bradshaw | 271/30.1 |
| 3,123,355 | 3/1964 | Lessig | 271/30.1 |
| 3,265,383 | 8/1966 | Shute | 271/11 |

FOREIGN PATENT DOCUMENTS

| | | |
|---|---|---|
| B135086/78 | 10/1979 | Australia . |
| 207778 | 1/1987 | European Pat. Off. . |
| 214149 | 10/1909 | Fed. Rep. of Germany . |
| 6833 | 1/1981 | Japan . |
| 6438 | 2/1982 | Japan . |
| 1296770 | 11/1972 | United Kingdom . |

*Primary Examiner*—H. Grant Skaggs
*Attorney, Agent, or Firm*—Morgan & Finnegan

[57] ABSTRACT

A paper feeding apparatus is provided wherein a paper supply shelf with a stack of paper sheets, from which the uppermost paper sheet of the stack is picked up, is guided for vertical movement and urged upwardly by the resilient force of a spring, and the upward movement of the paper supply shelf is limited by the engagement of the uppermost sheet of the stack with a stopper. The shelf is intermittently pushed down for a predetermined constant stroke by a click and ratchet arrangement. The picking up operation of the uppermost paper sheet of the stack is interlocked with the intermittently pushing down operation of the paper supply shelf, so that when the uppermost paper sheet of the stack is picked up, the paper supply shelf is synchronously lowered for a constant stroke.

3 Claims, 2 Drawing Sheets

PAPER FEEDING APPARATUS

BACKGROUND OF THE INVENTION

This invention relates to a paper feeding apparatus, especially to the paper feeding apparatus used with a collator or a printing machine.

As is known in the art, the paper feeding apparatus is intended to feed paper sheets one by one from a stack of paper sheets on a paper supply shelf into a machine such as a collator or a printing machine. In the paper feeding appartus, the paper sheets are commonly picked up from the top sheet of the stack, so that even thin paper sheets can be fed smoothly, but it would be necessary to gradually lift the paper supply shelf as the paper feeding operation proceeds.

For this reason, a special driving means for lifting the paper supply shelf has to be provided, and it is necessary to provide a sensor and a control section in order to control the position of the paper supply shelf, which makes the arrangement of the apparatus more complex and expensive.

Instead of lifing the paper supply shelf, it would be contemplated to lower it as the paper feeding operation proceeds. In this case, the structure of the apparatus would also be complex, not suitable for common use.

Another method of feeding paper sheets is to withdraw the lowest paper sheet while fixing the paper supply shelf in position. However, according to this method, thin paper sheets cannot be handled, nor is it possible to stack a large amount of paper sheets.

SUMMARY OF THE INVENTION

It is the object of the present invention to provide a paper feeding apparatus having a simple mechanism for lifting the paper supply shelf according to the picking up operation of paper sheets stacked on it sequentially from the uppermost paper sheet.

In order to achieve the object, the paper feeding apparatus according to the invention is provided with a frame, and a paper supply shelf with a stack of paper sheets, from which the uppermost paper sheet of the stack can be picked up, and guide means mounted on the frame for movement of the paper supply shelf in a substantially vertical direction, and spring means for urging the paper supply shelf upwardly, and stop means engageable with the uppermost paper sheet of the stack for defining the upper limit of the movement of the paper supply shelf, and suction means movable between a first position in which the suction means is engageble with the stack at its one edge portion to pick up the uppermost paper sheet of the stack and a second position in which the suction means is retracted above from the uppermost paper sheet of the stack, and means for intermittently pushing down the paper supply shelf for a predetermined stroke against the urging force of the spring means, and means for interlocking the movement of the suction means with the intermittently pushing down operation of the paper supply shelf, whereby when the suction means moves from the first position to the second position, the paper supply shelf is synchronously pushed down.

In a preferred embodiment of the invention, the means for intermittently pushing down the paper supply shelf may further include a ratchet rack fixed to the paper supply shelf, extending in parallel with the guide means, and a pushing click engageable with the ratchet rack, a support for rotatably supporting the pushing click, and means for actuating the support for vertically reciprocating movement with a predetermined stroke, and a spring for urging the pushing click in a direction for engagement with the ratchet rack during the downward movement of the support, and means for releasing the pushing click from engagement with the ratchet rack during the upward movement of the support.

In another embodiment of the invention, the paper feeding apparatus may further include means for actuating the suction means between the first position and the second position, and means for cooperatively connecting the means for actuating the support with the means for actuating the suction means.

In further embodiment of the invention, the means for interlocking the movement of the suction means with the intermittently pushing down operation of the paper supply shelf may further include a first peripheral cam for actuating the suction means through a first follower, and a second peripheral cam for actuating the support for the pushing click through a second follower, and a cam shaft on which the first and second cam are mounted for synchronous rotation.

PREFERRED EMBODIMENT OF THE INVENTION

Figure 1:
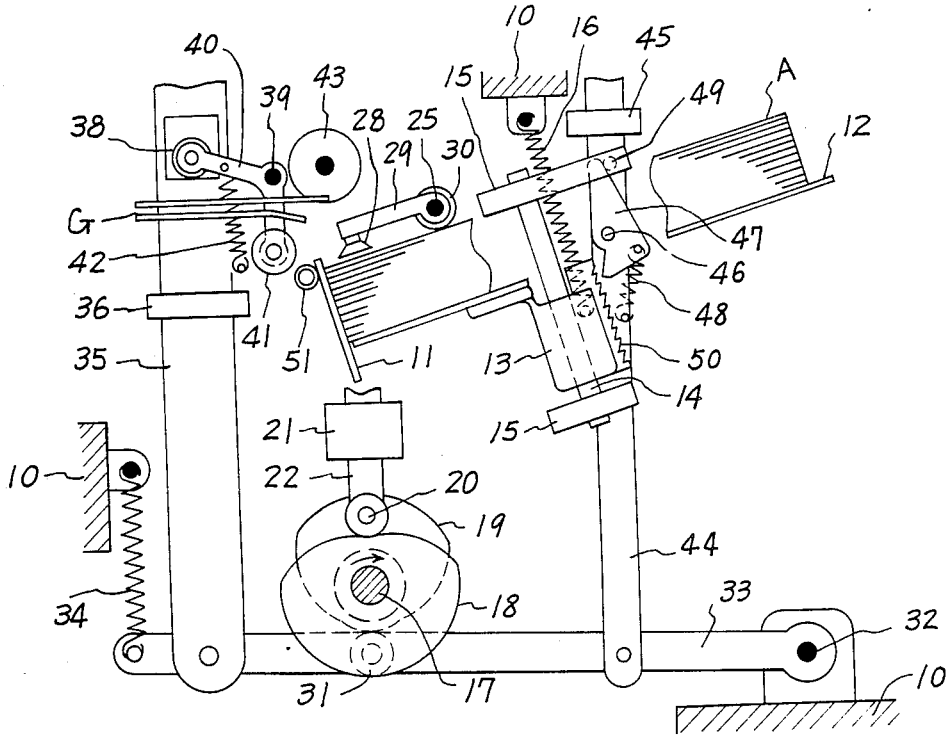
FIG. 1 is a front view showing an embodiment of the present invention.

A preferred embodiment of this invention will now be described with reference to the drawings. As is shown in FIG. 1, a front plate (11) is attached to a frame (10) of the apparatus such that it is slightly inclined from the vertical direction, serving as a stopper to define the front ends of paper sheets of the stack in setting the paper sheets in position. The numeral (12) denotes a paper supply shelf with a stack of paper sheets, from which the uppermost paper sheet of the stack can be picked up. The paper supply shelf (12) is disposed perpendicular to the surface of the front plate (11) and has a bearing (13) fixed to the lower portion thereof, whereby the paper supply shelf (12) is supported.

A guide shaft (14) is fixed to the frame (10) by a folder (15) such that the bearing (13) can slide along the guide shaft (14). Thus the paper supply shelf (12) is guided for substantially vertical movement. A spring (16) is attached between the bearing (13) and the frame (10) so as to urge the bearing (13), consequently the paper supply shelf (12) upwardly, A cam shaft (17) is supported on the frame (10), driven for rotation in the direction of arrow by a suitable power source. The cam shaft (17) has a first peripheral cam (18), and a second peripheral cam (19) fixed thereon, the peripheral cams (18), (19) being rotated in the same direction as the cam shaft (17).

Figure 2:
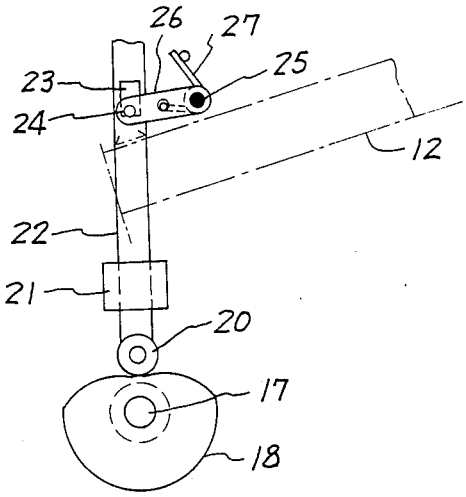
FIG. 2 is a front view showing a driving section for suction means.

The numeral (20) denotes a roller attached to a follower rod (22) which is guided for vertically reciprocating movement with a predetermined stroke by a guide (21). As is shown in FIG. 2, the upper portion of the follower rod (22) is formed with a hole (23), in which a pin (24) is inserted. The pin (24) is attached to an arm (26) which is integral with a freely rotatable shaft (25) supported on the frame (10).

Figure 3:
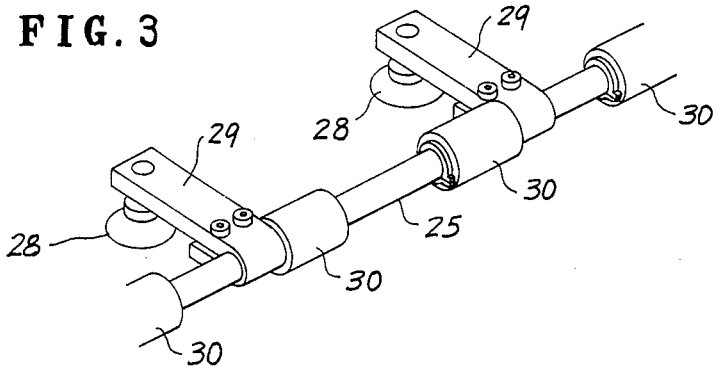
FIG. 3 is a perspective view showing the positions of stop means and suction means.
Figure 4:
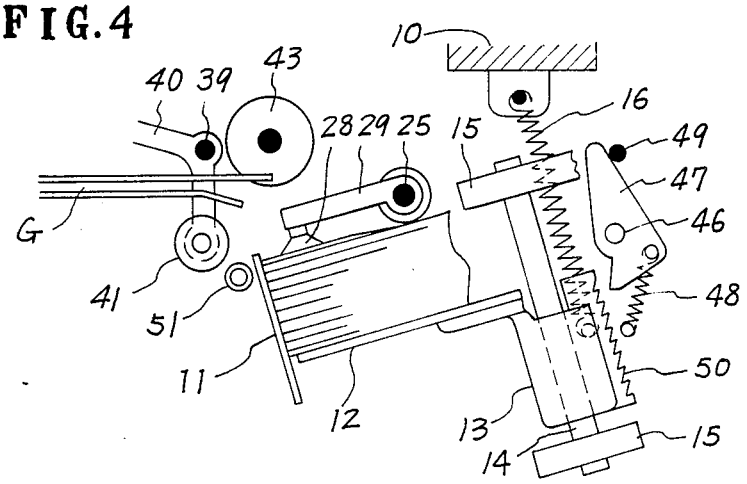
FIG. 4 is an enlarged front view of a paper supply shelf.

The arm (26) is biased counterclockwise around the shaft (25) by a spring (27). Thus, in response to the vertically reciprocating movement of the follower rod (22), the arm (26) swings. As is shown in FIG. 3, the shaft (25) is provided with arms supporting suckers (28) at their front ends for picking up the uppermost paper sheet (A) of the stack, and stop means in the form of rollers engageable with the uppermost paper sheet for defining the upper limit of the movement of the paper supply shelf (12).

Therefore, when the follower rod (22) moves upwardly, the suckers (28), which have been engageable with the uppermost paper sheet (A) of the stack, are retracted above from the top surface of the stack to pick up the uppermost paper sheet (A).

Referring to FIG. 1 again, a follower roller (31) in rolling contact with the second peripheral cam (19) is attached intermediate between the ends of a follower arm (33) which swings around a shaft (32) fixed to the frame (10).

Between the front end of follower arm (33) and the frame (10) is a spring (34) attached, consequently, as the second peripheral cam (19) is rotated, the follower arm (33) is swung around the shaft (32).

Furthermore, the lower end of an actuating plate (35) is connected to the follower arm (33). The actuating plate (35) is supported for vertically reciprocating movement with a predetermined stroke by a guide (36). The upper portion of the actuating plate (35) is formed with a hole (37), in which a roller (38) is inserted.

The roller (38) is supported on one front end of an arm (40) adapted for swing movement around a shaft (39) fixed to the frame (10), the other front end of the arm (40) supporting an idle roller (41).

A spring (42) is attached between the frame (10) and the arm (40) so as to urge the arm (40) clockwise around the shaft (39).

As the second peripheral cam (19) is rotated further, the actuating plate (35) is lowered, so that the arm (40) is turned counterclockwise under the action of the urging force of the spring (42). And when the actuating plate (35) is lowered to the lowest position, the idle roller (41) is pressed against the driving roller (43) which is disposed in a fixed position and rotating at all times.

The uppermost paper sheet (A) sucked and picked up by suckers (28) is nipped between the driving roller (43) and the idle roller (41). Then this paper sheet (A) is fed into between a pair of guide plates (G) of a machine such as a collator or a printing machine. Since the first and second peripheral cams (18), (19) are mounted on the same cam shaft (17), the movement of the suckers (28) and the movement of the idle and driving roller (41), (43) are synchronized with each other.

Furthermore, the lower end of a supporting plate (44) is connected to the follower arm (33). The supporting plate (44) is guided for vertical movement by a guide (45).

The supporting plate (44) is provided with a pushing click (47) supported for swing movement on a support in the form of a shaft (46). A spring (48) is attached between the supporting plate (44) and the pushing click (47) such that the pushing click (47) is biased clockwise by the resilient force of the spring (48).

The bearing (13) is also provided with a ratchet rack (50) extending in parallel with the guide shaft (14), and the pushing click (47) engages with the ratchet rack (50) by the bias force of the spring (48).

A pin (49) is fixed to the frame (10) or the guide (15) such that it releases the pushing click (47) from the engagement with the ratchet rack (50) as the supporting plate (44) moves upwardly. Thus as the supporting plate (44) moves upwardly, the back of the pushing click (47) is pushed by the pin, then the pushing click (47) is rotated counterclockwise around the shaft (46) against the bias force of the spring (48).

The numeral (51) denotes an air pipe, located forwardly of the front plate (11), provided with air outlet ports for blowing paper sheet to space between the uppermost paper sheet (A) of the stack and the next paper sheet.

Figure 5:
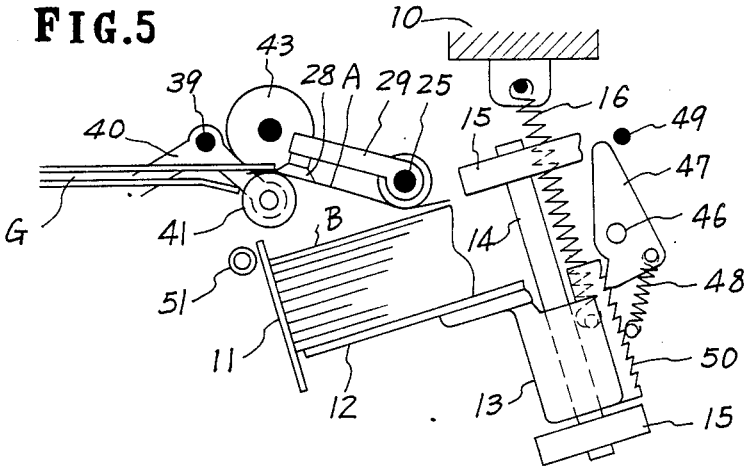
FIG. 5 is an enlarged front view of the paper supply shelf in a different operating position.

The operation of the paper feeding apparatus according to the invention will now be described. In order to stack paper sheets on the paper supply shelf (12), the bearing (13) is first pulled down against the urging force of the spring (16). Then, as shown in FIG. 5, the cam shaft (17) is rotated until the pushing click (47) engages with the ratchet rack (50). Thereby, the paper supply shelf (12) is held stationary, and paper sheets are stacked on the paper supply shelf (12).

Subsequently, as the supporting plate (44) moves upwardly according to the further rotation of the cam shaft (17), the pushing click (47) abuts against the pin (49) at its one end, and rotates counterclockwise about the shaft (46) against the urging force of the spring (48), and is released from the engagement with the ratchet rack (50), consequently the paper supply shelf (12) is lifted by the urging force of the spring (16). The upward movement of the paper supply shelf (12) continues until the uppermost paper sheet (A) of the stack abuts against the stopper (30). The state established by rotating the cam shaft (17) by a half a revolution is shown in FIG. 1.

Air is blown from the air outlet ports of the air pipe (51), whereby the uppermost paper sheet (A) is separated from the stack and floated. The uppermost paper sheet (A) thus floated is sucked by suckers (28).

With the rotation of the cam shaft (17), the suckers (28) start to lift around a shaft (25), and the second peripheral cam (19) causes the actuating plate (35) and the supporting plate (44) to start to move downwardly. Then, referring to FIG. 5, the pushing click (47) engages with the ratchet rack (50) of the paper supply shelf (12). Therefore, the paper supply shelf (12) is moved downwardly.

When the paper supply shelf (12) is moved downwardly, a clearance corresponding in amount to one tooth or two teeth of the ratchet rack (50) is defined between the paper sheet (A) and the next paper sheet (B).

On the other hand, the downward movement of the actuating plate (35) causes the idle roller (41) to approach the drive roller (43), so that the paper sheet (A) transported by the suckers (28) is nipped by the idle roller (41) and the driving roller (43). After the paper sheet (A) has thus been nipped, the suckers (28) cut off the suction air.

Since the driving roller (43) is continuously rotated, the paper sheet (A) is fed into between the guide plates (G). Because of the clearance defined between the uppermost paper sheet (A) and the next paper sheet (B), the paper sheet (A) is delivered with ease.

At this time, since the stoppers (30) act to bend the paper sheet (A), the paper sheet (A) will be delivered without being forced to assume a shape unsuitable for feeding. In the case where the stoppers (30) are rollers, it is desirable that they rotate lightly so as not to form a resistance to the delivery of paper sheets which are stiff.

Further rotation of the cam shaft (17) causes the suckers (28) to descend for paper sheets of the stack. Then, as the supporting plate (44) moves upwardly according to the further rotation of the cam shaft (17), the pushing click (47) abuts against the pin (49) at its one end, and rotates counterclockwise about the shaft (46) against the urging force of the spring (48), and is released fromo the engagement with the ratchet rack (50), consequently the paper supply shelf (12) is moved upwardly by the urgent force of the spring (16). The upward movement of the paper supply shelf (12) continues until the uppermost paper sheet (A) of the stack abuts against the stopper (30).

When the uppermost paper sheet abuts against the stoppers (30), air is blown from the air pipe (51) to start paper separation. Since the paper sheets are held down by the stoppers (30), the air cannot blow through them and hence the portion of the paper sheet extending from the front end thereof of the stoppers (30) is separated and floated.

According to the invention described so far in detail, in the paper feeding apparatus wherein paper sheets stacked on the paper supply shelf are picked up sequentially from the uppermost one, the resilient force of a spring is used to move the paper supply shelf upwardly as the feeding operation of the paper sheets proceeds, thus eliminating the need for a special power source for the upward movement of the shelf. Furthermore, since the upward movement of the paper supply shelf is stopped by the uppermost paper sheet of the stack abutting against the stoppers, there is no need for providing a sensor and a control section for controlling the position of the paper supply shelf. Thus the arrangement of the apparatus can be simplified.

We claim:

1. A paper feeding apparatus comprising:

a frame;

a paper supply shelf with a stack of paper sheets, from which the uppermost paper sheet of said stack can be picked up; guide means which is mounted on said frame and to which said paper supply shelf is slidably engaged for movement of said paper supply shelf in a substantially vertical direction;

spring means for urging said paper supply shelf upwardly;

stop means engageable with the uppermost paper sheet of said stack for defining the upper limit of the movement of said paper supply shelf;

suction means movable between a first position in which said suction means is engageable with the uppermost paper sheet of said stack and a second position in which said suction means is retracted above from the top surface of said stack to pick up said uppermost paper sheet;

means for intermittently pushing down said paper supply shelf for a predetermined stroke against the urging force of said spring means, said means for intermittently pushing down said paper supply shelf comprising; a ratchet rack fixed to said paper supply shelf, said ratchet rack extending in parallel with the direction of the movement of said paper supply shelf; a pushing click engageable with said ratchet rack; a support for rotatably supporting said pushing click; means for actuating said support for vertically reciprocating movement with a predetermined stroke; a spring for urging said pushing click in a direction for engagement with said ratchet rack during the downward movement of said support; means for releasing said pushing click from engagement with said ratchet rack during the upward movement of said support;

means for interlocking the movement of said suction means with the intermittently pushing down operation of said paper supply shelf, whereby when said suction means moves from said first position to said second position, said paper supply shelf is synchronously pushing down for the predetermined stroke against the urging force of said spring means.

2. A paper feeding apparatus according to claim 1 further comprising:

means for actuating said suction means between said first position and said second position;

means for cooperatively connecting said means for actuating said support with said means for actuating said suction means.

3. A paper feeding apparatus according to claim 2 wherein said means for interlocking the movement of said suction means with the intermittently pushing down operation of said paper supply shelf comprising:

a first peripheral cam for actuating said suction means through a first follower;

a second peripheral cam for actuating said support for said pushing click through a second follower;

a cam shaft on which said first and second cam are mounted for synchronous rotation.

* * * * *

UNITED STATES PATENT AND TRADEMARK OFFICE

CERTIFICATE OF CORRECTION

PATENT NO. : 4,930,763

DATED : June 5, 1990

INVENTOR(S) : Yoshiyuki Horii et al

It is certified that error appears in the above-identified patent and that said Letters Patent is hereby corrected as shown below:

In Col. 1, line 12, "appartus" should read -- apparatus --.

In Col. 2, line 58, the comma (,) should be a period (.).

In Col. 5, line 14, "fromo" should read -- from --; on line 25, "of" should read -- to --.

Signed and Sealed this

Fifth Day of May, 1992

*Attest:*

*Attesting Officer*

DOUGLAS B. COMER

*Acting Commissioner of Patents and Trademarks*